US010614645B1

(12) United States Patent
Tsai et al.

(10) Patent No.: US 10,614,645 B1
(45) Date of Patent: Apr. 7, 2020

(54) INTELLIGENT DOOR LOCK, CONTROL METHOD THEREOF, AND UNLOCKING APPARATUS AND METHOD THEREOF

(71) Applicant: Industrial Technology Research Institute, Hsinchu (TW)

(72) Inventors: Yi-Min Tsai, Hsinchu County (TW); Yung-Han Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 16/233,137

(22) Filed: Dec. 27, 2018

(30) Foreign Application Priority Data

Dec. 14, 2018 (TW) ..... 107145315 A

(51) Int. Cl.
*G07C 9/00* (2020.01)
*E05B 47/00* (2006.01)

(52) U.S. Cl.
CPC ..... *G07C 9/00309* (2013.01); *E05B 47/0001* (2013.01); *E05B 2047/0053* (2013.01); *G07C 2009/00507* (2013.01)

(58) Field of Classification Search
None
See application file for complete search history.

(56) References Cited

U.S. PATENT DOCUMENTS 6,556,125 B1 4/2003 Rohrl
7,984,937 B2 7/2011 Tanimoto et al.
9,109,379 B1 8/2015 Ranchod
9,277,370 B2 * 3/2016 Addepalli ..... H04W 72/0406
9,349,282 B2 * 5/2016 Luna ..... H04R 3/00
9,652,917 B2 5/2017 Johnson et al.
10,219,102 B2 * 2/2019 Jang ..... H04W 4/33
2007/0126561 A1 6/2007 Breed
(Continued)

FOREIGN PATENT DOCUMENTS

CN 101839087 9/2010
CN 102561826 7/2012
(Continued)

OTHER PUBLICATIONS

"Office Action of Taiwan Counterpart Application," dated Aug. 13, 2019, p. 1-p. 14.
(Continued)

*Primary Examiner* — John F Mortell
(74) *Attorney, Agent, or Firm* — JCIPRNET

(57) ABSTRACT

An intelligent door lock, a control method thereof, and an unlocking apparatus and method thereof are provided. The unlocking method is adapted for an unlocking apparatus to unlock a door lock apparatus, and includes following steps. Receiving a plurality of broadcast packages sent by the door lock apparatus in response to an operation on the door lock apparatus, and detecting a variation in signal strengths of the broadcast packets caused by the operation. Reading a stage message, which is recorded in each of the broadcast packages, of the door lock apparatus corresponding to the operation. Determining whether a variation of the stage messages matches a variation of the signal strengths of the broadcast packages. Sending an unlocking signal to the door lock apparatus for executing unlocking if a determination result indicates match.

20 Claims, 9 Drawing Sheets

(56) References Cited

U.S. PATENT DOCUMENTS

| | | | | |
|---|---|---|---|---|
| 2018/0040183 | A1* | 2/2018 | Cheng | G07C 9/00309 |
| 2018/0340350 | A1* | 11/2018 | Johnson | E05B 65/06 |

FOREIGN PATENT DOCUMENTS

| | | |
|---|---|---|
| CN | 102915588 | 2/2013 |
| CN | 203285178 | 11/2013 |
| CN | 105261104 | 1/2016 |
| CN | 106256981 | 12/2016 |
| CN | 106891853 | 6/2017 |
| CN | 206376636 | 8/2017 |
| CN | 107393071 | 11/2017 |
| TW | 200827520 | 7/2008 |
| TW | I310800 | 6/2009 |
| TW | M492940 | 1/2015 |
| TW | I570315 | 2/2017 |
| TW | 201802336 | 1/2018 |
| TW | 201821317 | 6/2018 |

OTHER PUBLICATIONS

Grant Ho, et al., "Smart Locks: Lessons for Securing Commodity Internet of Things Devices," Electrical Engineering and Computer Sciences University of California at Berkeley, Mar. 2016, pp. 461-472.

* cited by examiner

INTELLIGENT DOOR LOCK, CONTROL METHOD THEREOF, AND UNLOCKING APPARATUS AND METHOD THEREOF

CROSS-REFERENCE TO RELATED APPLICATION

This application claims the priority benefits of Taiwan application serial no. 107145315, filed on Dec. 14, 2018. The entirety of the above-mentioned patent application is hereby incorporated by reference herein and made a part of this specification.

BACKGROUND

Technical Field

The disclosure relates to an unlocking method and apparatus, and particularly relates to an intelligent door lock, a control method thereof and an unlocking apparatus and method of the intelligent door lock.

Description of Related Art

Intelligent door locks establish communication between mobile devices and door locks in a wireless communication transmission manner, so that users may reduce the trouble of carrying keys with them, and as long as a wireless communication function of the smart mobile devices is used to connect with the door locks, the smart mobile devices may be applied to open the door locks without using physical keys, which is convenient and safe.

However, unlocking procedures of some intelligent door locks are complicated, so that the unlocking procedures of the intelligent door locks are one of the current research and development directions.

SUMMARY

The disclosure provides an unlocking method of an intelligent door lock, which is adapted to an unlocking apparatus to unlock a door lock apparatus, and the unlocking method includes following steps: receiving a plurality of broadcast packets sent by the door lock apparatus in response to an operation, and detecting a variation in signal strengths of the broadcast packets; reading a stage message, which is included in each of the broadcast packets, of the door lock apparatus corresponding to the operation; determining whether a variation of the stage messages matches a variation of the detected signal strengths of the broadcast packets; and sending an unlocking signal to the door lock apparatus to execute unlocking in a condition that the variation of the stage messages matches the variation of the signal strengths of the broadcast packets.

The disclosure provides an unlocking apparatus of an intelligent door lock, which includes a wireless signal transceiver and a processor. The wireless signal transceiver is used for sending and receiving wireless signals. The processor is coupled to the wireless signal transceiver, and is configured to use the wireless signal transceiver to receive a plurality of broadcast packets sent by a door lock apparatus in response to an operation, detect a variation in signal strengths of the broadcast packets, read a stage message, which is recorded in each of the broadcast packets, of the door lock apparatus corresponding to the operation, determine whether a variation of the stage messages matches a variation of the signal strengths of the broadcast packets, and send an unlocking signal to the door lock apparatus to execute unlocking in a condition that the variation of the stage messages matches the variation of the signal strengths of the broadcast packets.

The disclosure provides a control method of an intelligent door lock, which is adapted to a door lock apparatus, and the control method includes following steps: detecting an operation on the door lock apparatus; sequentially generating a plurality of stage messages corresponding to the operation in response to the operation, and sending a plurality of broadcast packets including the stage messages; and receiving an unlocking signal sent by an unlocking apparatus in response to a matching result of a variation of signal strengths of the broadcast packets and a variation of the stage messages in the broadcast packets, so as to execute unlocking.

The disclosure provides an intelligent door lock including a wireless signal transceiver, a door lock and a processor. The wireless signal transceiver is used for sending and receiving wireless signals. The door lock is used for detecting an operation of a user. The processor is coupled to the wireless signal transceiver and the door lock, and is configured to sequentially generate a plurality of stage messages corresponding to the operation in response to the operation detected by the door lock, and send a plurality of broadcast packets including the stage messages by using the wireless signal transceiver, and receive an unlocking signal sent by an unlocking apparatus in response to a matching result of a variation of detected signal strengths of the broadcast packets and a variation of the stage messages in the broadcast packets, so as to execute unlocking.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

In an embodiment of the disclosure, a door handle or a door lock apparatus sends a plurality of specific signals when it is operated (rotated and/or triggered), and a smart phone or a wearable device receives and records a variation of signal strengths, so as to determine whether the smart phone or the wearable device is located within a space for unlocking the door lock according to the variation. If the variation is consistent with an identification feature, the smart phone or the wearable device may be connected with the intelligent door lock through a wireless communication manner, and transmits an unlocking instruction to execute unlocking. Moreover, the intelligent door lock may determine whether the received unlocking signal is within a recognizable angle range through an Angle Of Arrival (AOA) positioning method to serve as a basis for determining whether the user is inside or outside the door, so as to decide whether to unlock the door lock.

Figure 1:
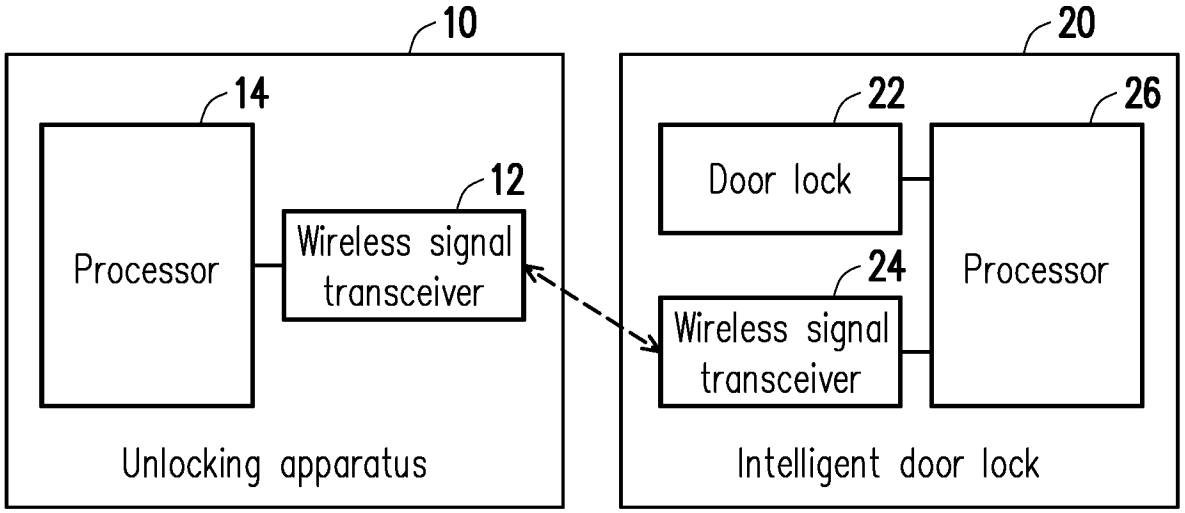
FIG. 1 is a block diagram of a control system of an intelligent door lock according to an embodiment of the disclosure.

FIG. 1 is a block diagram of a control system of an intelligent door lock according to an embodiment of the disclosure. Referring to FIG. 1, in this embodiment, in a situation that an unlocking apparatus 10 performs an unlocking operation on the intelligent door lock 20 is described, where the unlocking apparatus 10 is, for example, a mobile device such as a smart phone, a tablet Personal Computer (PC), etc., carried by a user, or a wearable device such as a smart watch, a smart band, a smart ring, etc., worn on the user, which may assist the user to unlock the intelligent door lock 20 through an operation such as turning a door handle, etc., and the user does not need to worry about other people unlocking the intelligent door lock 20.

The unlocking apparatus 10, for example, includes a wireless signal transceiver 12 and a processor 14. The wireless signal transceiver 12 is, for example, a communication device supporting a short range wireless communication standard such as Bluetooth, Wi-Fi, Near Field Communication (NFC) or Device to Device (D2D) communication, etc., which may receive a wireless signal sent by the intelligent door lock 20, and may send a wireless signal to the intelligent door lock 20. The processor 14 is, for, example, a Central Processing Unit (CPU), other programmable general purpose or special purpose microprocessor, a Digital Signal Processor (DSP), a programmable controller, an Application Specific Integrated Circuits (ASIC), a Programmable Logic Device (PLD) or other similar device or a combination of the above devices. The processor 14 is coupled to the wireless signal transceiver 12, and is used for processing the wireless signal received by the wireless signal transceiver 12, and sending wireless signals through the wireless signal transceiver 12.

The intelligent door lock 20, for example, includes a door lock 22, a wireless signal transceiver 24 and a processor 26. The wireless signal transceiver 24 also supports the short range wireless communication standard such as Bluetooth, Wi-Fi, NFC or D2D communication, etc., and corresponds to the wireless signal transceiver 12 of the unlocking apparatus 10, and is adapted to perform wireless signal communication with the wireless signal transceiver 12. For example, the wireless signal transceiver 24 may broadcast a beacon carrying unlocking related information to the unlocking apparatus 10 located within a communication range by using a Bluetooth Low Energy (BLE) technique for the unlocking apparatus 10 to confirm and execute the unlocking operation. The door lock 22 is, for example, a lock including a horizontal door handle, and a user may perform an operation of turning the horizontal door handle to unlock the door lock 22. In other embodiments, the door lock 22 may also be a touch lock requiring a touch and/or drag operation to implement unlocking, or any type of an electronic lock or a mechanical lock that the operation may cause a relative position variation between the unlocking apparatus 10 and the door lock 22, which is not limited by the disclosure. The type of the processor 26 is similar to that of the processor 14, and detail thereof is not repeated.

Figure 2:
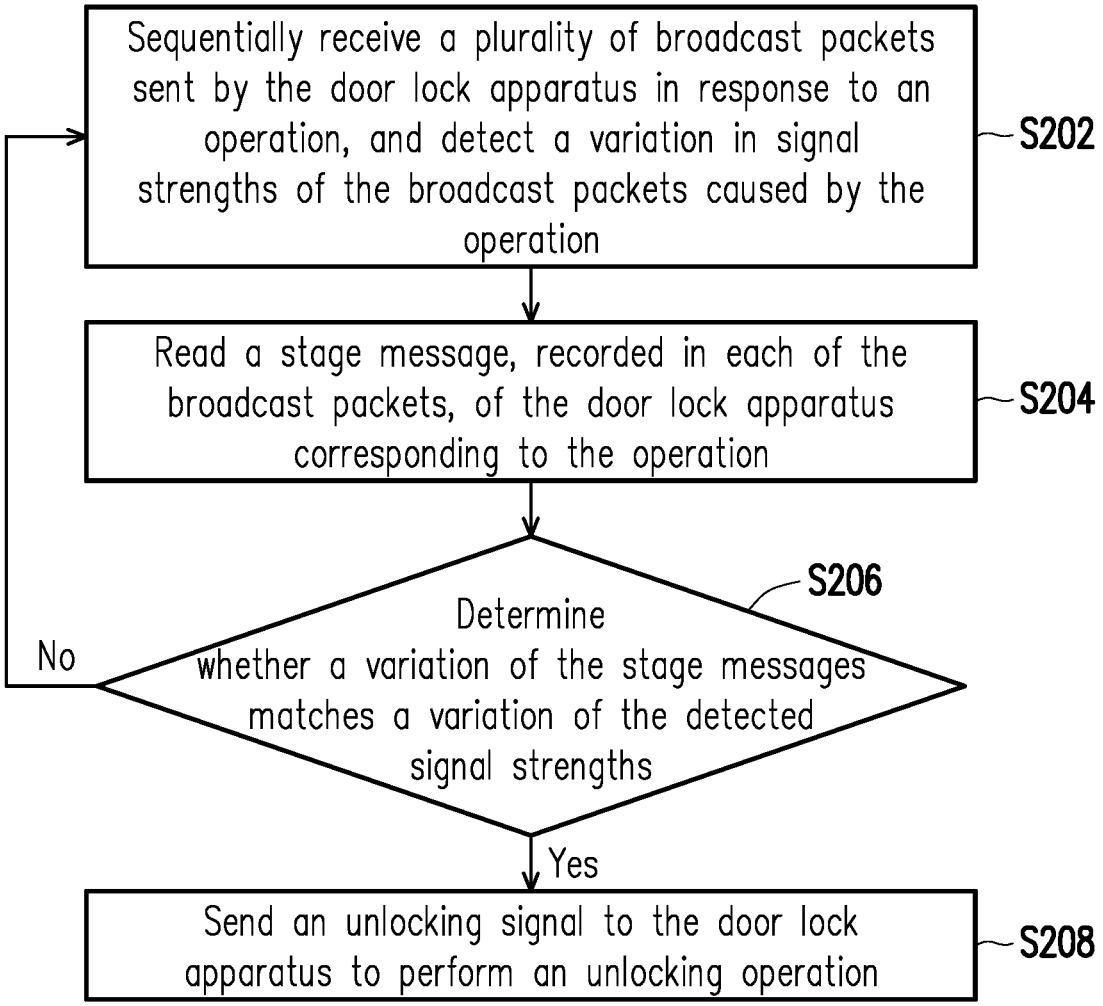
FIG. 2 is a flowchart illustrating an unlocking method of an intelligent door lock according to an embodiment of the disclosure.

FIG. 2 is a flowchart illustrating an unlocking method of an intelligent door lock according to an embodiment of the disclosure. Referring to FIG. 1 and FIG. 2, the method of the embodiment is adapted to the unlocking apparatus 10 of FIG. 1, and detailed steps of the unlocking method of the intelligent door lock of the disclosure are described below with reference of various components of the unlocking apparatus 10 and the intelligent door lock 20.

First, the processor 14 of the unlocking apparatus 10 uses the wireless signal transceiver 12 to sequentially receive a plurality of broadcast packets which are sent by the intelligent door lock 20 in response to an operation performed on the door lock 22 by the user, and detects a variation in signal strengths of the broadcast packets caused by the operation (step S202). The door lock 22, for example, includes a rotatable horizontal door handle. The rotation of the door lock 22 may be divided into a plurality of stages according to different rotation angles. The intelligent door lock 20, for example, correspondingly generates a stage message according to a stage of the horizontal door handle rotated by the operation. For example, when the horizontal door handle is rotated to a $1^{st}$ stage, a stage message with a value of 1 is generated, and when the horizontal door handle is rotated to a $2^{nd}$ stage, a stage message with a value of 2 is generated, and the others are deduced by analogy. The intelligent door lock 20 sends broadcast packets at different time points when the user rotates the horizontal door handle to different stages, and embeds the stage message corresponding to the stage in the broadcast packet, such that the unlocking apparatus 10 receiving the broadcast packet may learn the stage of the horizontal door handle rotated by the operation to serve as a basis for confirming the unlocking operation. In an embodiment, the intelligent door lock 20, for example, uses parameters Major in Bluetooth beacon broadcast packets to serve as the stage messages, and respectively generates stage messages of [Major:1], [Major:2], [Major:3] corresponding to the $1^{st}$, $2^{nd}$, $3^{rd}$ stages of the rotated horizontal door handle.

On the other hand, the operation performed on the door lock 22 by the user may also affect the signal strengths of the broadcast packets, which is sent from the intelligent door lock 20, received by the unlocking apparatus 10. For example, in the aforementioned embodiment where the door lock 22 is implemented by the horizontal door handle, an antenna (not shown) of the wireless signal transceiver 24 may be configured at an axial area of the horizontal door handle of the intelligent door lock 20. In an embodiment, an antenna angle of the antenna is fixed towards the horizontal door handle (for example, an angle with the strongest signal). When the user's hand rotates the horizontal door handle, since a position of a wrist thereof is changed relative to an axis of the horizontal door handle, the signal strength of the broadcast packet which is sent from the above antenna and received by the smart watch or smart band is varied, and a variation magnitude thereof is related to the angle or stage of the horizontal door handle rotated by the user. In this embodiment, the smart watch or smart band worn on the wrist of the user is served as the unlocking apparatus 10. Namely, in a situation that the antenna angle is horizontally oriented towards the horizontal door handle, when the user just holds the horizontal door handle, the signal strength of the broadcast packets, which is sent from the antenna and received by the unlocking apparatus 10, is the strongest.

When the user starts to rotate the horizontal door handle, the unlocking apparatus 10 is gradually deviated from the antenna angle along with gradual increase of the rotation angle, and the signal strength of the received broadcast packets is gradually weakened. It should be noted that in other embodiments, the antenna of the wireless signal transceiver 12 is not limited to be configured at the axial area of the horizontal door handle. The antenna of the wireless signal transceiver 12 may be configured at other positions of the intelligent door lock 20 as long as the signal strength of the broadcast packets detected by the unlocking apparatus 10 varies when the user rotates the door handle, and such variation may also be converted into a variation relationship between the rotation angle (or stage) of the door handle and the signal strength. In one embodiment, the variation relationship may be generated through pre-measurement and stored in a database.

Moreover, in an embodiment, the antenna direction/angle may be changed along with increase of the stage of the horizontal door handle rotated by the user. For example, a horizontal line is taken as a reference line, the antenna is rotated to or keep at 0° when the door handle is rotated to −5°, the antenna is rotated to 270° when the door handle is rotated to −10°, the antenna is rotated to 180° when the door handle is rotated to −15°, and the antenna is rotated to 90° when the door handle is rotated to −20°, and thereafter, the antenna is rotated by 90° for 5° rotation of the door handle each time. Since the antenna angle is changed along with the rotation stages of the horizontal door handle when the user rotates the horizontal door handle, the signal strengths of the broadcast packets, which are sent from the above antenna and received by the smart watch or smart band worn on the user's wrist or even the smart phone carried by the user, are varied, and a variation magnitude thereof has a certain relationship with the angle or stage of the horizontal door handle rotated by the user. The above change of the antenna direction/angle is, for example, implemented through a mechanical linkage manner, where a single antenna is rotated along with rotation of the door handle. In another embodiment, the above change of the antenna direction/angle is implemented by switching multiple antennas. Different antennas, which may be configured at a same position, point to different directions or different angles, and different antennas are switched to send signals according to different rotation stages of the door handle. In this way, the change of the antenna direction/angle may also be achieved.

In an embodiment of the disclosure, based on the variation relationship between the rotation angles of the door handle and the signal strengths, the intelligent door lock 20 transmits related information of the rotation of the door handle to the unlocking apparatus 10 in a way of transmitting broadcast packets. The unlocking apparatus 10 may compare the related information with the detected signal strengths of the broadcast packets, so as to determine whether to perform the unlocking operation.

In detail, referring to the flow of FIG. 2, after receiving the broadcast packets sent by the intelligent door lock 20, the processor 14 of the unlocking apparatus 10 reads a stage message, recorded in each of the broadcast packets, of the intelligent door lock 20 corresponding to the operation of the user (step S204), and determines whether a variation of the stage messages matches a variation of the signal strengths detected in the received broadcast packets (step S206).

If a determination result indicates match in step S206, it is determined that the user operating the intelligent door lock 20 is the user having the unlocking apparatus 10. The processor 14 of the unlocking apparatus 10 uses the wireless signal transceiver 12 to transmit an unlocking signal to the intelligent door lock 20 to perform an unlocking operation (step S208). On the contrary, if the determination result indicates mismatch in step S206, the unlocking apparatus 10 does not execute the unlocking operation, and the flow returns to the step S202 to continually receive the broadcast packets and detect the signal strength.

In an embodiment, the unlocking apparatus 10, for example, has obtained a control authority of the intelligent door lock 20 and an authorization key used for verifying the control authority in advance, and stores the authorization key in a storage device such as an inbuilt memory, etc. Therefore, when performing the unlocking operation, for example, the unlocking apparatus 10 sends an unlocking signal containing the authorization key to the intelligent door lock 20 to obtain the control authority of the intelligent door lock 20, so as to unlock the door lock 22. In other embodiment, when the unlocking apparatus 10 is to perform the unlocking operation, the unlocking apparatus 10 is connected to a door lock management platform through the wireless signal transceiver 12 or other types of communication mechanisms (not shown), so as to obtain the control authority of the intelligent door lock 20 and the authorization key used for verifying the control authority, and sends the unlocking signal containing the authorization key to the intelligent door lock 20 to obtain the control authority of the intelligent door lock 20 to unlock the door lock 22. The embodiment does not limit the manner of performing the unlocking operation.

Besides the aforementioned unlocking method of the unlocking apparatus, the disclosure also provides a corresponding control method of the intelligent door lock, such that the intelligent door lock may send an unlocking-related message to the unlocking apparatus in response to the operation of the user, so as to confirm the unlocking operation.

Figure 3:
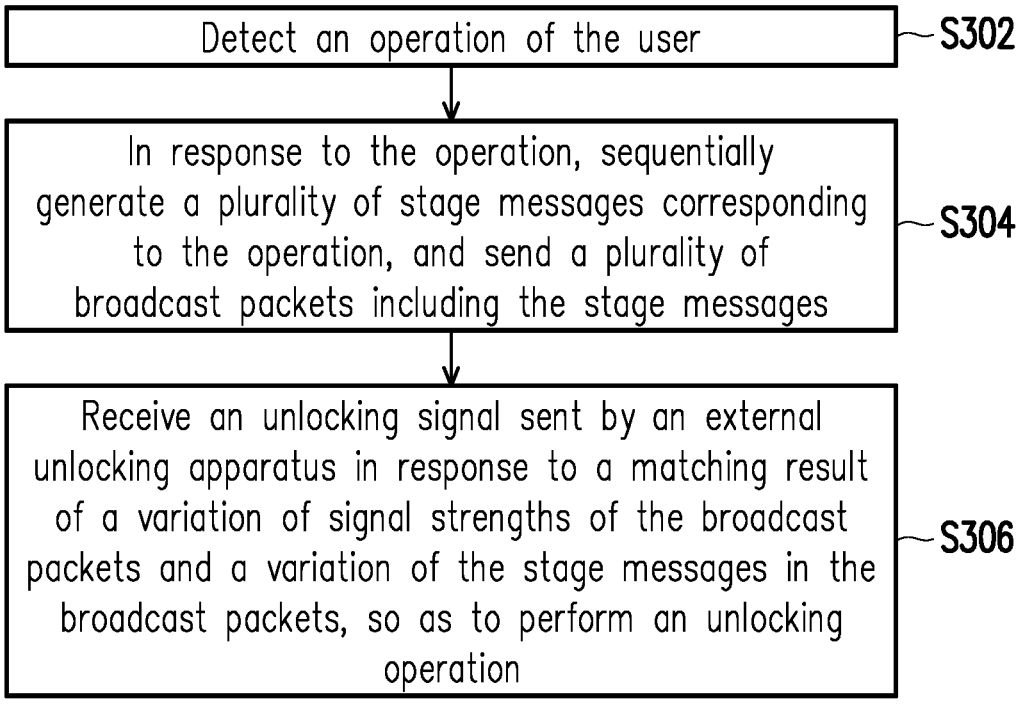
FIG. 3 is a flowchart illustrating a control method of an intelligent door lock according to an embodiment of the disclosure.

In detail, FIG. 3 is a flowchart illustrating a control method of an intelligent door lock according to an embodiment of the disclosure. Referring to FIG. 1 and FIG. 3, the method of the embodiment is adapted to the intelligent door lock 20 of FIG. 1, and detailed steps of the unlocking method of the intelligent door lock of the disclosure are described below with reference of various components in the unlocking apparatus 10 and the intelligent door lock 20.

First, the processor 26 of the intelligent door lock 20 may use the door lock 22 to detect an operation of the user (step S302). In an embodiment, the door lock 22 is, for example, configured with a touch sensor (not shown), and when detecting a touch operation of the user, the touch sensor powers on the intelligent door lock 20 and/or triggers the processor 26 to start generating stage messages to send broadcast packets. In an embodiment, when the door lock 22 is rotated to a certain angle (for example, rotated to −1°), it is also determined as the operation of the user and powers on the intelligent door lock 20 and/or triggers the processor 26 to start generating stage messages to send broadcast packets. In other embodiments, the door lock 22 may be configured with any type of other sensor or switch adapted to detect the operation of the user, which is not limited by the disclosure.

When the door lock 22 detects the operation of the user, the processor 26 sequentially generates a plurality of stage messages corresponding to the operation, and uses the wireless signal transceiver 24 to send a plurality of broadcast packets including the stage messages (step S304). For example, in the aforementioned embodiment that the door lock 22 is implemented by the horizontal door handle, the processor 26 may generate the stage messages according to the stages of the horizontal door handle rotated by the operation, and embeds the stage messages in the broadcast packets for sending the broadcast packets to the unlock apparatus 10 located within the communication range.

After sending the broadcast packets, the processor 26 uses the wireless signal transceiver 24 to receive an unlocking signal sent by the unlocking apparatus 10 in response to a matching result of a variation of signal strengths of the broadcast packets and a variation of the stage messages in the broadcast packets, so as to perform the unlocking operation (step S306).

Figure 4A:
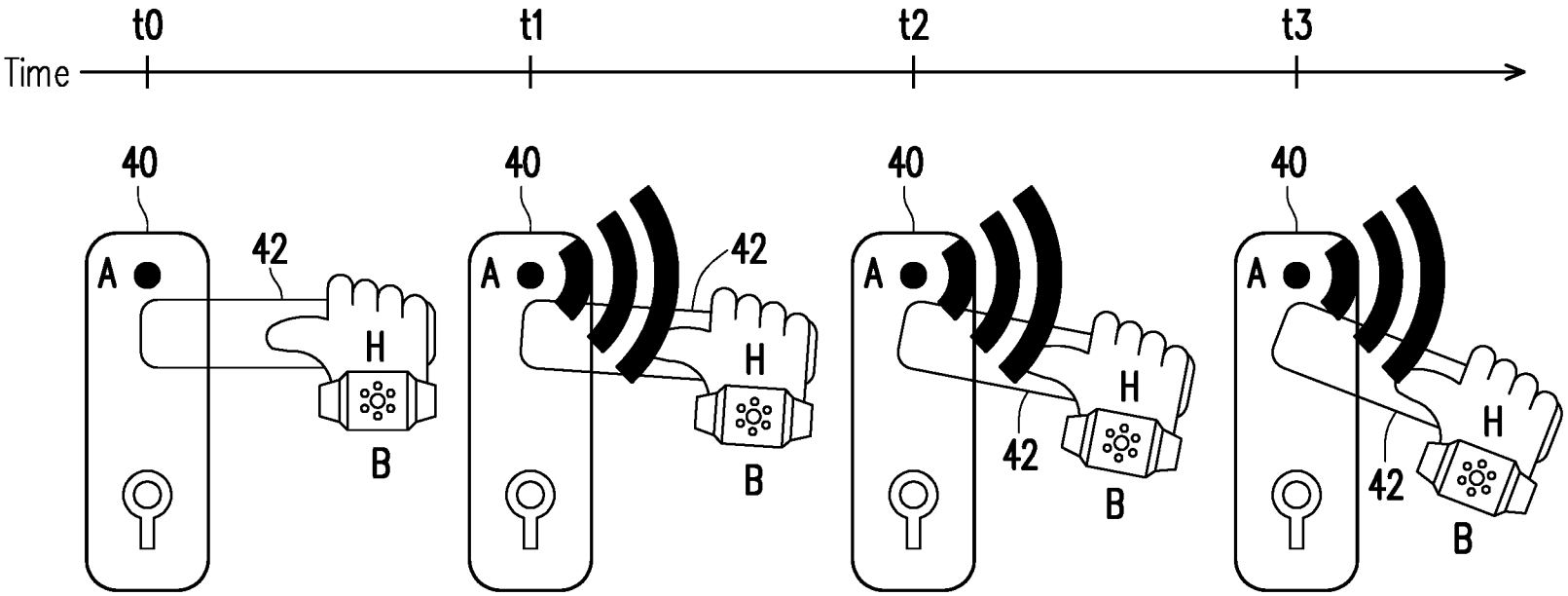
FIG. 4A and FIG. 4B illustrate an example of an unlocking method of an intelligent door lock according to an embodiment of the disclosure.
Figure 4B:
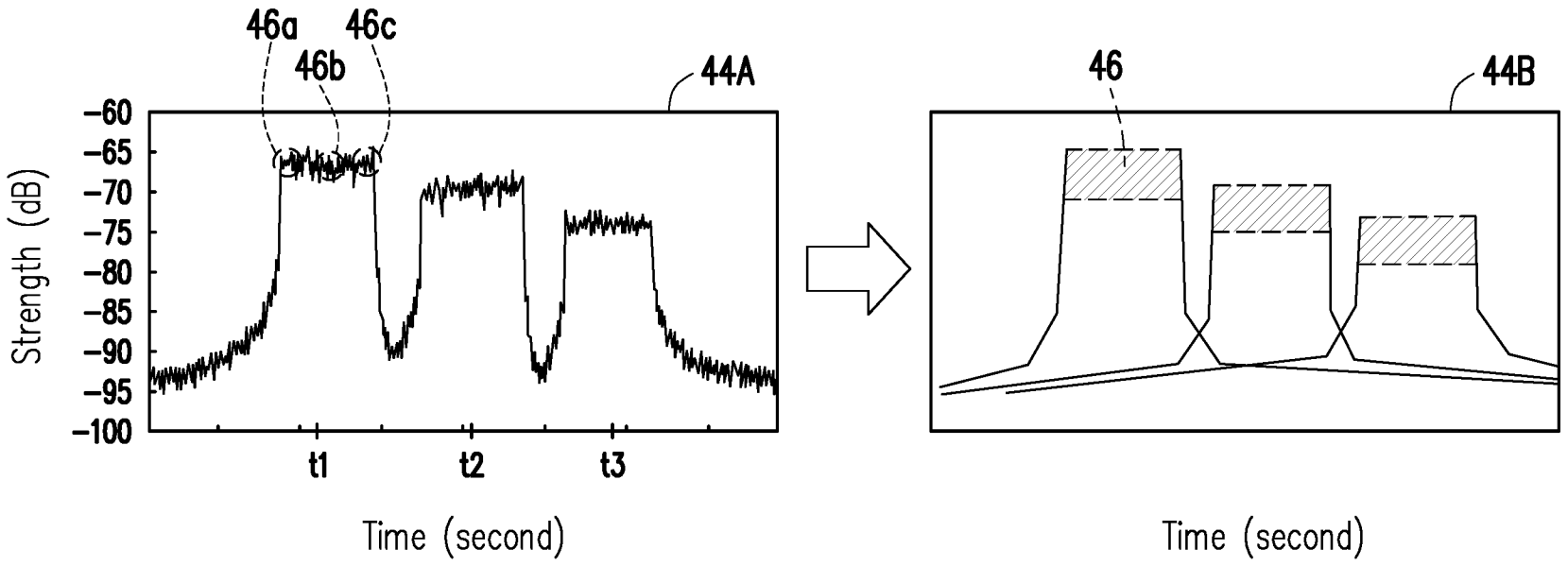

For example, it is assumed that the antenna angle of the intelligent door lock is fixed, and FIG. 4A and FIG. 4B illustrate an example of the unlocking method of the intelligent door lock according to an embodiment of the disclosure. Referring to FIG. 4A, the intelligent door lock 40 of the embodiment includes a horizontal door handle 42 and an antenna A, the user wears a smart watch B on a hand H. In the embodiment, the smart watch B is the unlocking apparatus 10. The antenna A is disposed at an axial area of the horizontal door handle 42 and an antenna angle of the antenna A horizontally points to the horizontal door handle 42 (for example, an angle with the strongest signal). When the user's hand H holds the horizontal door handle 42 (at a time point t0), the intelligent door lock 40 is powered on. During the process that the user's hand H rotates the horizontal door handle 42, it is assumed that the horizontal door handle 42 is respectively rotated to $1^{st}$, $2^{nd}$, $3^{rd}$ stages at time points t1, t2, t3. The intelligent door lock 40 may generate stage messages of [Major:1], [Major:2], [Major:3], and embed the stage messages in the broadcast packets for transmitting the broadcast packets to the smart watch B. Along with the increase of the rotation angle of horizontal door handle 42, the smart watch B worn on the hand H is gradually deviated from the angle of the antenna A with the strongest signal. Therefore, the signal strengths detected in the received broadcast packets, which are received by the smart watch B, are gradually weakened.

FIG. 4B illustrates a signal strength diagram 44A of the broadcast packets detected when the smart watch B receives the broadcast packets from the antenna A, which is, for example, a Received Signal Strength Indication (RSSI) diagram. The smart watch B, for example, obtains an average of each of the waveforms in the signal strength diagram 44A to serve as a characteristic value of each of the waveforms. Taking the waveform of the broadcast packet corresponding to the time point t1 as an example, an average of signal strengths 46*a*, 46*b* and 46*c* (or average of signal strengths during time corresponding to signal strength 46*a* to time corresponding to signal strength 46*c*) may be calculated to serve as the characteristic value to illustrate a waveform 46 shown in a waveform diagram 44B. Deduced by analogy, the characteristic values of the waveforms of the broadcast packets corresponding the time points t2 and t3 may be calculated. By calculating variations of the averages of each of the waveforms (the average of each of the waveforms, for example, is −20 dbm, −22 dbm, −30 dbm, respectively) in the waveform diagram 44B. For example, a variation of −2 dbm (−22−(−20)) between the waveform of t1 and the waveform of t2 and a variation of −8 dbm (−30−(−22)) between the waveform of t2 and the waveform of t3. The calculated variations of the waveforms and the variations of the stage messages [Major:1], [Major:2], [Major:3] in the received broadcast packets may be compared with the variations of the waveforms and the variations of the stage messages recorded in a database. In FIG. 4B, the stage messages (representing the stages) are increased along with the increase of time, and the variation of the averages of the signal strengths between each waveform is increased along with the increase of time. Both of the above variations are complied with the operational situation of FIG. 4A recorded in the database, so that it is determined that the smart watch B and the intelligent door lock 40 are matched. In an embodiment, the matching of the smart watch B and the intelligent door lock 40 may be determined according to the averages of the signal strengths of the waveforms or a trend of the averages of the signal strengths of the waveforms. For example, when the averages of the signal strengths of the waveforms are decreased along with the increase of the stage messages, it is determined that the smart watch B and the intelligent door lock 40 are matched. Therefore, the smart watch B sends an unlocking signal to the intelligent door lock 40 to perform the unlocking operation.

Figure 5A:
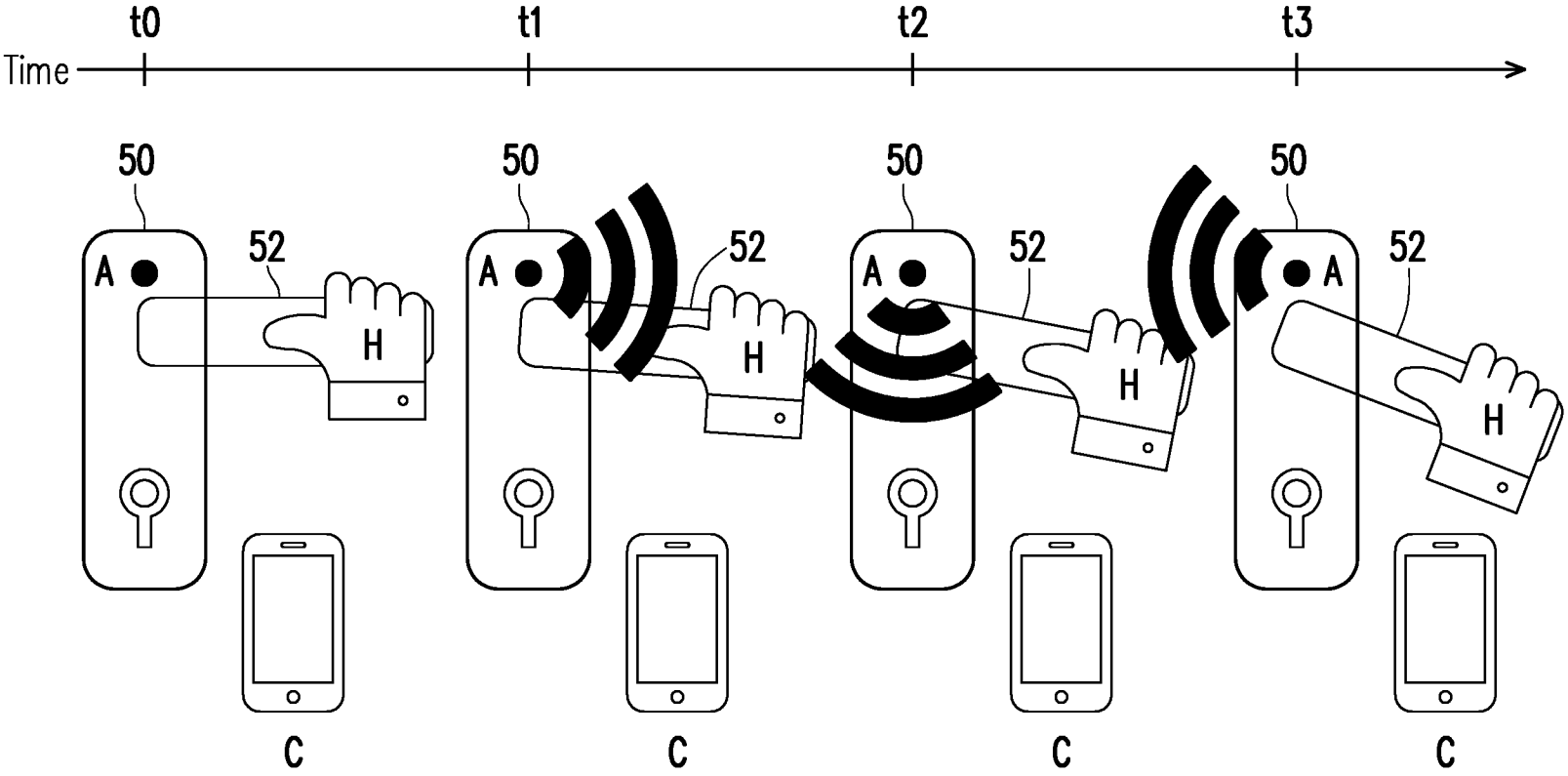
FIG. 5A and FIG. 5B illustrate an example of an unlocking method of an intelligent door lock according to an embodiment of the disclosure.
Figure 5B:
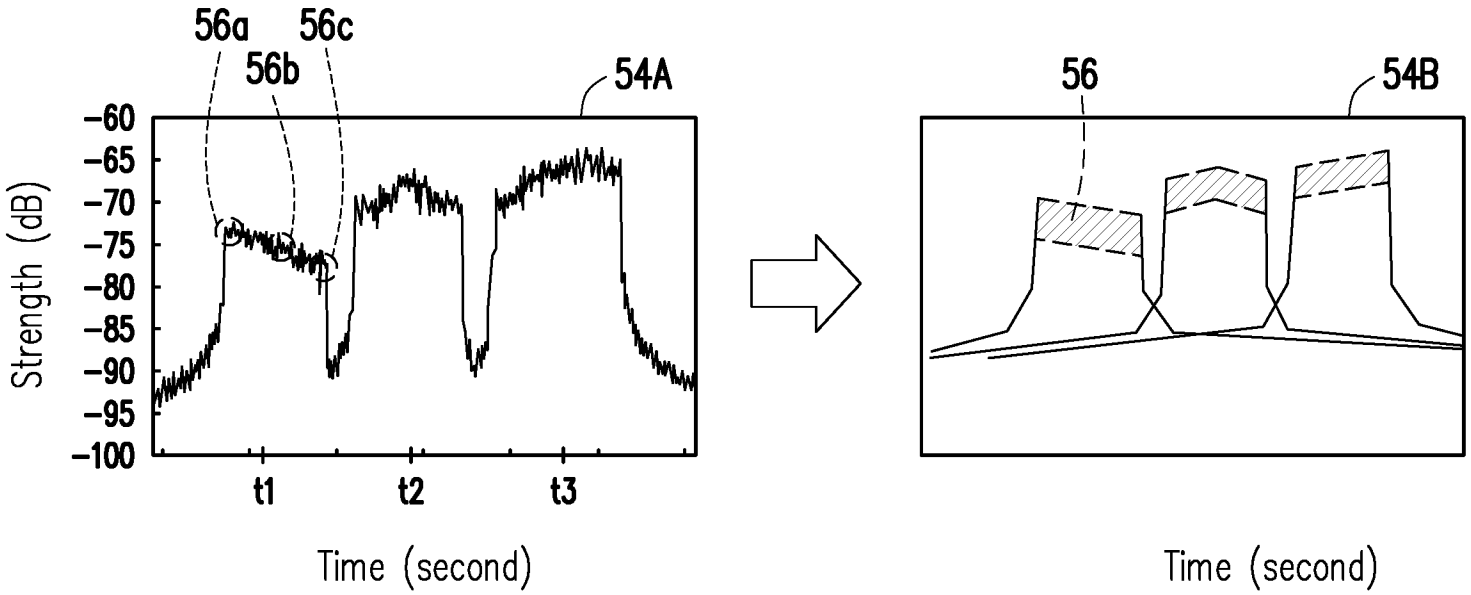

On the other hand, it is assumed that the antenna angle of the intelligent door lock is changed along with rotation of the door handle, and FIG. 5A and FIG. 5B illustrate an example of the unlocking method of the intelligent door lock according to an embodiment of the disclosure. Referring to FIG. 5A, the intelligent door lock 50 of the embodiment includes a horizontal door handle 52 and an antenna A. When the user's hand H rotates the horizontal door handle 52, another hand (not shown) of the user holds a smart phone C, and in the embodiment, the smart phone C is the unlocking apparatus 10. When the user's hand H holds the horizontal door handle 52 (at a time point t0), the intelligent door lock 50 is powered on. During the process that the user's hand H rotates the horizontal door handle 52, it is assumed that the horizontal door handle 52 is respectively rotated to $1^{st}$, $2^{nd}$, $3^{rd}$ stages at time points t1, t2, t3, the intelligent door lock 50 may generate stage messages of [Major:1], [Major:2], [Major:3], and embed the stage messages in the broadcast packets for transmitting the stage messages to the smart phone C.

In this embodiment, along with the process that the horizontal door handle 52 is respectively rotated to the $1^{st}$, $2^{nd}$ and $3^{rd}$ stages, the antenna angle of the antenna A is changed from 0° corresponding to the $1^{st}$ stage (at the time point t1) to 270° corresponding to the $2^{nd}$ stage (at the time point t2), and is then changed to 180° corresponding to the $3^{rd}$ stage (at the time point t3). Along with the increase of the rotation angle, the smart phone C may receive wireless signals from different directions, so that curves of the wireless signals may include obvious variations.

FIG. 5B illustrates a signal strength diagram 54A of the broadcast packets detected when the smart phone C receives the broadcast packets from the antenna A, which is, for example, a RSSI diagram. The smart phone C, for example, obtains an average of each of the waveforms in the signal strength diagram 54A to serve as a characteristic value of such waveform. Taking the waveform corresponding to the time point t1 as an example, an average of signal strengths 56*a*, 56*b* and 56*c* (or average of signal strengths during time corresponding to signal strength 56*a* to time corresponding to signal strength 56*c*) may be calculated to serve as the characteristic value to illustrate a waveform 56 shown in a waveform diagram 54B. Deduced by analogy, the characteristic values of the waveforms corresponding the time points t2 and t3 may be calculated. By calculating variations of the averages of each of the waveforms (which are, for example, respectively −20 dbm, −26 dbm, −29 dbm) in the waveform diagram 54B, for example, a variation of −6 dbm (−26−(−20)) between the waveform of t1 and the waveform of t2 and a variation of −3 dbm (−29−(−26)) between the waveform of t2 and the waveform of t3. The calculated variations of the averages of each of the waveforms and the variations of the stage messages [Major:1], [Major:2], [Major:3] in the received broadcast packets may be compared with the variations of the averages of each of the waveforms and the variations of the stage messages recorded in a database. In FIG. 5B, the stage messages (representing the stages) are increased along with the increase of time, and the variation of the averages of the signal strengths between each waveform is decreased along with the increase of time. Both of the above variations are complied with the operational situation of FIG. 5A recorded in the database, so that it is determined that the smart phone C and the intelligent door lock 50 are matched. In an embodiment, the matching of the smart phone C and the intelligent door lock 50 may be determined according to the averages of the signal strengths of the waveforms or a trend of the averages of the signal strengths. For example, when the averages of the signal strengths of the waveforms are increased along with the increase of the stage messages (representing the stage), it is determined that the smart phone C and the intelligent door lock 50 are matched. Therefore, the smart phone C sends an unlocking signal to the intelligent door lock 50 to execute the unlocking operation.

In an embodiment, when the unlocking apparatus 10 determines that the user wants to unlock the intelligent door lock 20, the unlocking apparatus 10, for example, automatically searches unlocking information of the intelligent door lock 20, and sends a connection request to try to establish a communication connection with the intelligent door lock 20. In this case, the intelligent door lock 20 may determine whether a signal of the connection request is from a location within a recognizable angle range in front of the door based on an Angle of Arrival (AOA) positioning method, so as to avoid a situation of taking another person as the proper user to open the door when the unlocking apparatus 10 is located indoors and the another person outside the door rotates the door handle.

Figure 6:
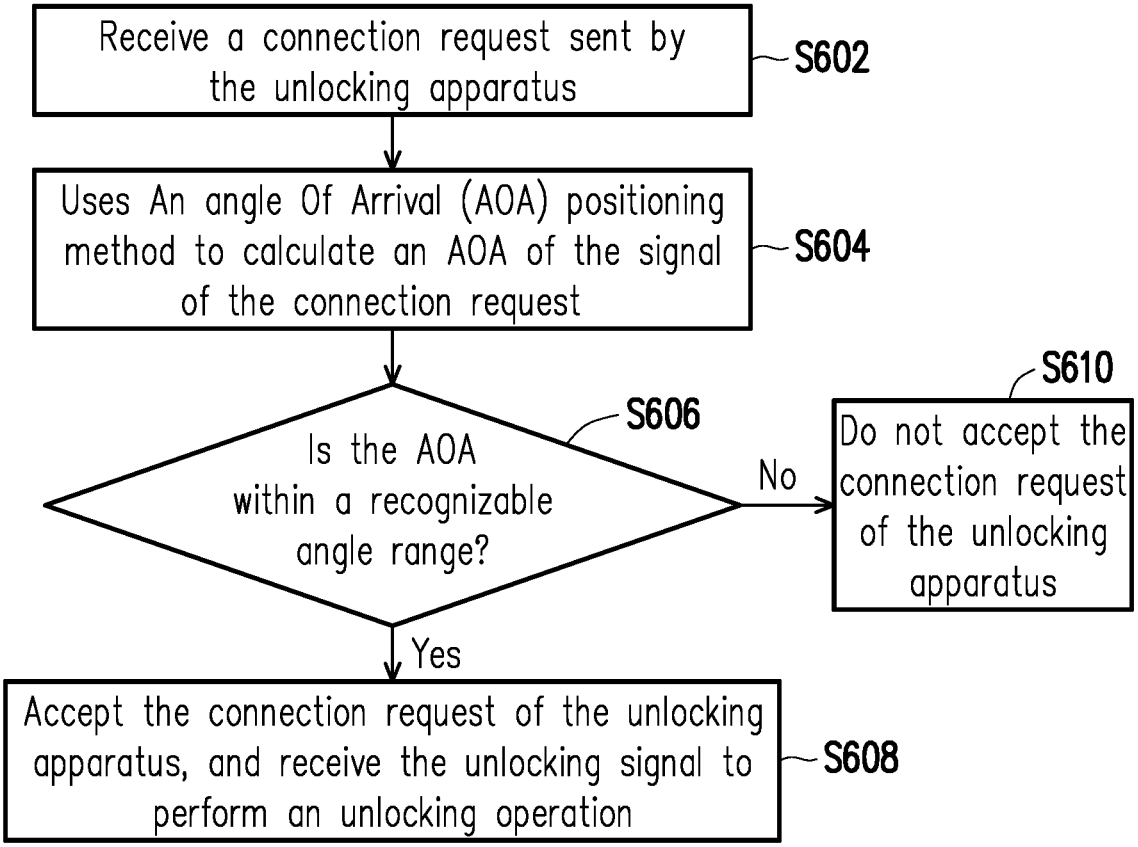
FIG. 6 is a flowchart illustrating a control method of an intelligent door lock according to an embodiment of the disclosure.

For example, FIG. 6 is a flowchart illustrating a control method of the intelligent door lock according to an embodiment of the disclosure. Referring to FIG. 1, FIG. 3 and FIG. 6, in one embodiment of the disclosure, the method of the embodiment describes detailed steps of the step S306 of FIG. 3.

First, the processor 26 of the intelligent door lock 20 uses the wireless signal transceiver 24 to receive a connection request which is sent by the unlocking apparatus 10 by using the wireless signal transceiver 12 (step S602). Then, the processor 26 uses the AOA positioning method to calculate an AOA of the signal of the connection request received by the wireless signal transceiver 24 (step S604), and determines whether the AOA is within a recognizable angle range (step S606).

If it is determined that the AOA is within the recognizable angle range, the processor 26 accepts the connection request of the unlocking apparatus 10, and receives the unlocking signal to perform an unlocking operation (step S608). If it is determined that the AOA is not within the recognizable angle range, the processor 26 does not accept the connection request of the unlocking apparatus 10 (step S610).

Figure 7:
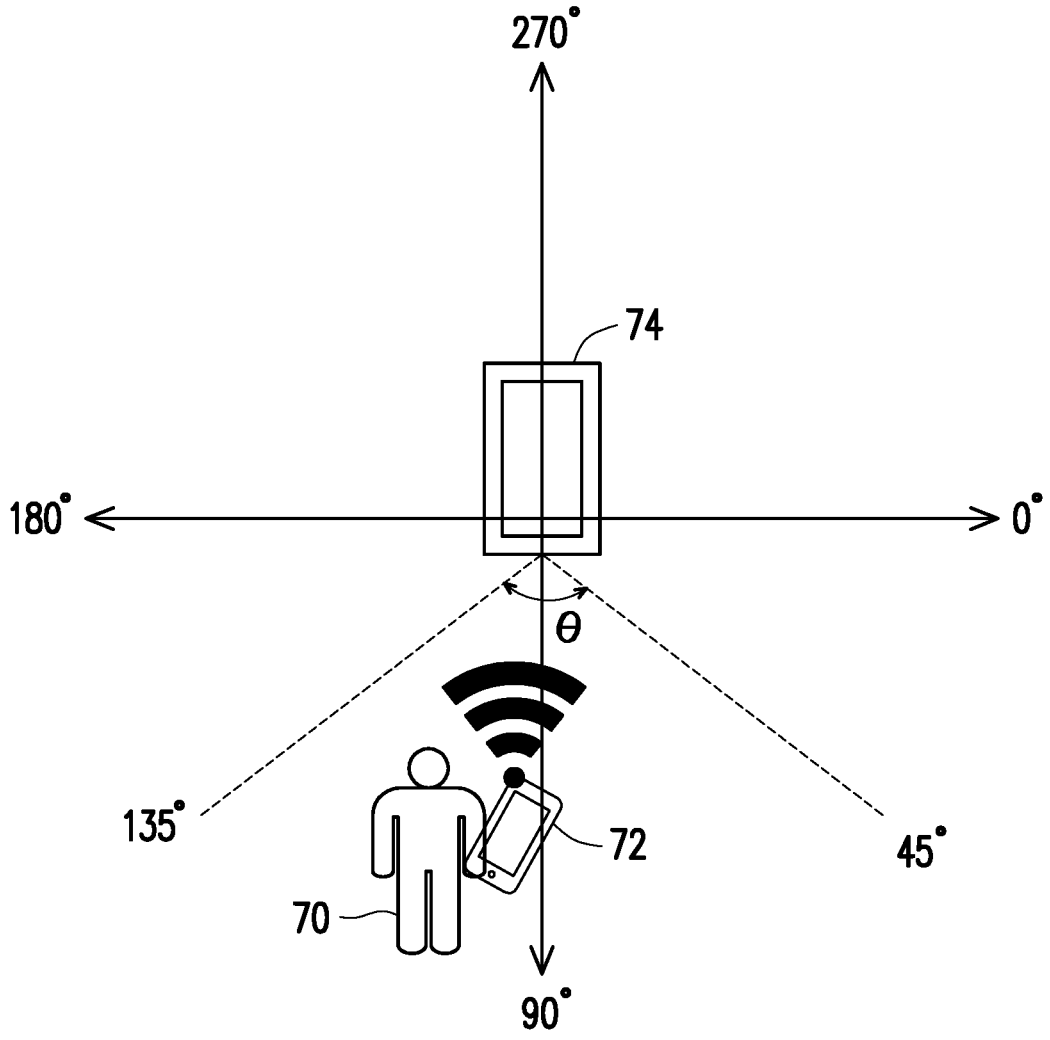
FIG. 7 is an example of a recognizable angle range according to an embodiment of the disclosure.

For example, FIG. 7 is an example of the recognizable angle range according to an embodiment of the disclosure. Referring to FIG. 7, the recognizable angle range of the embodiment refers to an angle range (i.e. a range covered by an angle θ) between 45° and 135° in front of a door 74. The recognizable angle range limits a user 70 having a handheld smart phone 72 to stand in front of the door 74 to perform the unlocking operation, in order that the intelligent door lock (not shown) on the door 74 can accept the connection request and execute unlocking according to the unlocking signal.

By adding the aforementioned limitation condition of the recognizable angle range to the unlocking method of the aforementioned embodiment, it may further prevent bad guys from opening the door lock.

In summary, the intelligent door lock and the control method thereof and the unlocking apparatus of the intelligent door lock and the method thereof of the disclosure provide a linkage mode between user's operation on the door lock and communication, which confirms the user's unlocking intention and avoids occurrence of misoperation. Moreover, the disclosure also provides a method for determining a spatial position of the unlocking apparatus, where only when the user is located within a specific space, the unlocking is triggered, so as to prevent other people from unlocking the door.

It will be apparent to those skilled in the art that various modifications and variations can be made to the disclosed embodiments without departing from the scope or spirit of the disclosure. In view of the foregoing, it is intended that the disclosure covers modifications and variations provided they fall within the scope of the following claims and their equivalents.

What is claimed is:

1. An unlocking method of an intelligent door lock, adapted to an unlocking apparatus to unlock a door lock apparatus, and the unlocking method comprising:

receiving a plurality of broadcast packets sent by the door lock apparatus in response to an operation, and detecting a variation in signal strengths of the broadcast packets;

reading a stage message, included in each of the broadcast packets, of the door lock apparatus corresponding to the operation;

determining whether a variation of the stage messages matches a variation of the signal strengths of the broadcast packets; and sending an unlocking signal to the door lock apparatus to execute unlocking in a condition that the variation of the stage messages matches the variation of the signal strengths of the broadcast packets.

2. The unlocking method of the intelligent door lock as claimed in claim 1, wherein the door lock apparatus comprises a horizontal door handle, and the stage messages of the door lock apparatus corresponding to the operation comprise a stage of the horizontal door handle rotated by the operation.

3. The unlocking method of the intelligent door lock as claimed in claim 2, wherein the door lock apparatus further comprises at least one antenna used for sending the broadcast packets, and an antenna angle of the antenna is varied along with rotation of the horizontal door handle.

4. The unlocking method of the intelligent door lock as claimed in claim 2, wherein the door lock apparatus further comprises a plurality of antennas used for sending the broadcast packets and having different antenna angles, and one of the antennas is switched to send a corresponding one of the broadcast packets along with rotation of the horizontal door handle.

5. The unlocking method of the intelligent door lock as claimed in claim 1, wherein the step of determining whether the variation of the stage messages matches the variation of the signal strengths of the broadcast packets comprises:

obtaining a characteristic value of the signal strength of each of the broadcast packets; and comparing a variation of the characteristic values with the variation of the stage messages to determine whether the variation of the characteristic values and the variation of the stage messages matches.

6. The unlocking method of the intelligent door lock as claimed in claim 1, further comprising:

connecting a door lock management platform to obtain a control authority of the door lock apparatus and an authorization key used for verifying the control authority, and sending the unlocking signal containing the authorization key to the door lock apparatus to obtain the control authority of the door lock apparatus to execute unlocking.

7. An unlocking apparatus of an intelligent door lock, comprising:

a wireless signal transceiver, sending and receiving wireless signals; and a processor, coupled to the wireless signal transceiver, and configured to:

use the wireless signal transceiver to receive a plurality of broadcast packets sent by a door lock apparatus in response to an operation, and detect a variation in signal strengths of the broadcast packets;

read a stage message, included in each of the broadcast packets, of the door lock apparatus corresponding to the operation;

determine whether a variation of the stage messages matches a variation of the signal strengths of the broadcast packets; and send an unlocking signal to the door lock apparatus to execute unlocking in a condition that the variation of the stage messages matches the variation of the signal strengths of the broadcast packets.

8. The unlocking apparatus as claimed in claim 7, wherein the processor is further configured to:

obtain a characteristic value of the signal strength of each of the broadcast packets; and compare a variation of the characteristic values with the variation of the stage messages to determine whether the variation of the characteristic values and the variation of the stage messages matches.

9. The unlocking apparatus as claimed in claim 7, wherein the processor is further configured to:

use the wireless signal transceiver to connect a door lock management platform to obtain a control authority of the door lock apparatus and an authorization key used for verifying the control authority, and send the unlocking signal containing the authorization key to the door lock apparatus to obtain the control authority of the door lock apparatus to execute unlocking.

10. A control method of an intelligent door lock, adapted to a door lock apparatus, and the control method of the intelligent door lock comprising:

detecting an operation on the door lock apparatus;

sequentially generating a plurality of stage messages corresponding to the operation in response to the operation, and sending a plurality of broadcast packets including the stage messages; and receiving an unlocking signal sent by an unlocking apparatus in response to a matching result of a variation of signal strengths of the broadcast packets and a variation of the stage messages in the broadcast packets, so as to execute unlocking.

11. The control method of the intelligent door lock as claimed in claim 10, wherein the door lock apparatus comprises a horizontal door handle, and the step of sequentially generating the stage messages corresponding to the operation in response to the operation comprises:

generating the stage messages corresponding to stages of the horizontal door handle rotated by the operation.

12. The control method of the intelligent door lock as claimed in claim 11, wherein the door lock apparatus further comprises at least one antenna, and the step of sending the broadcast packets recording the stage messages comprises:

changing an antenna angle of the antenna along with rotation of the horizontal door handle, so as to send the broadcast packets.

13. The control method of the intelligent door lock as claimed in claim 11, wherein the door lock apparatus further comprises a plurality of antennas used for sending the broadcast packets and having different antenna angles, and the step of sending the broadcast packets recording the stage messages comprises:

switching to one of the antennas to send a corresponding one of the broadcast packets along with rotation of the horizontal door handle.

14. The control method of the intelligent door lock as claimed in claim 10, wherein before the step of receiving the unlocking signal to execute unlocking, the control method further comprises:

receiving a connection request sent by the unlocking apparatus;

using an Angle of Arrival (AOA) positioning method to calculate an AOA of a signal of the connection request, and determining whether the AOA is within a recognizable angle range; and accepting the connection request of the unlocking apparatus when it is determined that the AOA is within the recognizable angle range, so as to receive the unlocking signal.

15. An intelligent door lock, comprising:

a wireless signal transceiver, sending and receiving wireless signals;

a door lock, detecting an operation; and a processor, coupled to the wireless signal transceiver and the door lock, and configured to sequentially generate a plurality of stage messages corresponding to the operation in response to the operation detected by the door lock, and send a plurality of broadcast packets including the stage messages by using the wireless signal transceiver, and receive an unlocking signal sent by an unlocking apparatus in response to a matching result of a variation of signal strengths of the broadcast packets and a variation of the stage messages in the broadcast packets, so as to execute unlocking.

16. The intelligent door lock as claimed in claim 15, wherein the door lock comprises a horizontal door handle, and detects a stage of the horizontal door handle rotated by the operation; and the processor generates the stage message according to the stage.

17. The intelligent door lock as claimed in claim 16, wherein the wireless signal transceiver comprises:

at least one antenna, wherein an antenna angle of the antenna is varied along with rotation of the horizontal door handle, so as to send the broadcast packets.

18. The intelligent door lock as claimed in claim 16, wherein the wireless signal transceiver comprises:

a plurality of antennas, having different antenna angles, and switched to one of the antennas to send a corresponding one of the broadcast packets along with rotation of the horizontal door handle.

19. The intelligent door lock as claimed in claim 15, wherein the wireless signal transceiver comprises:

at least one antenna, receiving a connection request sent by the unlocking apparatus, wherein the processor uses an Angle of Arrival (AOA) positioning method to calculate an AOA of a signal of the connection request, and determines whether the AOA is within a recognizable angle range, and when it is determined that the AOA is within the recognizable angle range, the processor accepts the connection request of the unlocking apparatus, so as to receive the unlocking signal.

20. The intelligent door lock as claimed in claim 15, wherein the door lock comprises a touch sensor, wherein when detecting a touch operation, the touch sensor triggers the processor to start generating the stage messages and sending the broadcast packets.

* * * * *